US005956975A

United States Patent [19]

Kawashima

[11] Patent Number: 5,956,975

[45] Date of Patent: Sep. 28, 1999

[54] METHOD OF KNITTING A COLLAR

[75] Inventor: Tadahiro Kawashima, Wakayama, Japan

[73] Assignee: Shima Seiki Manufacturing, Ltd., Wakayama, Japan

[21] Appl. No.: 08/917,380

[22] Filed: Aug. 26, 1997

[30] Foreign Application Priority Data

Aug. 30, 1996 [JP] Japan ..... 8-231101

[51] Int. Cl.[6] ..... D04B 7/10

[52] U.S. Cl. ..... 66/64; 66/172 R

[58] Field of Search ..... 66/176, 171, 172 R, 66/175, 64, 69, 70, 76, 60 R

[56] References Cited

U.S. PATENT DOCUMENTS 5,584,197 12/1996 Okuno .

FOREIGN PATENT DOCUMENTS 3-75656 12/1991 Japan .
04153346 5/1992 Japan .
WO 92/01728 4/1992 WIPO .

*Primary Examiner*—John J. Calvert
*Assistant Examiner*—Larry D. Worrell, Jr.
*Attorney, Agent, or Firm*—Nikaido Marmelstein Murray & Oram LLP

[57] ABSTRACT

The wale of a collar closest to the body side is transferred from a front body to a back body, then the wale is moved towards the neck hole side. Next, said wale is moved further towards the neck hole side, and a new wale of the collar is transferred onto the needle of the back body before said move. Each wale of the collar that has been transferred is moved towards the neck hole side. In a similar manner all the wales of the collar are transferred.

4 Claims, 5 Drawing Sheets

METHOD OF KNITTING A COLLAR

FIELD OF THE INVENTION

The present invention relates to a method of knitting a collar, in particular, a method of knitting a collar on the periphery of a neck hole, together with a body, on a flat knitting machine, said collar having continuous wales.

PRIOR ART

In recent years, with the progress made in flat knitting machines, research efforts have been made to link various parts such sleeves, body and pockets that constitute knit garments such as vest, sweater and cardigan during the knitting processes on a flat knitting machine. Such a method can reduce an after treatment or seaming, and the products are called seamless knits. There are known methods of linking a collar to a body during knitting the collar. For example, there is Japanese Provisional Patent HEI 4-153346 of the present applicant. According to this method, both a front needle bed and a back needle bed are used to knit a front body and a back body, one being laid on the other, one in front and the other in the rear. In the course of knitting the body, the front body is divided into a left front half body and a right front half body to form a neck hole such as V neck. Along the circumference of the neck hole a front collar consisting of an appropriate number of wales is formed integrally with the body. Whenever a prescribed number of courses of the body including the front collar are knitted, stitches of the collar will be shifted towards the body side so as to open the hole sequentially. In this way the neck hole is formed.

According to the above-mentioned method, it is disclosed that a neck hole is formed in the body and that reinforcing knitting is made on the periphery of the hole formed. The method, however, does not disclose a method of knitting a back collar in such a way that the back collar is continuous to the wales of a front collar formed on the periphery of the neck hole.

Subsequently the present applicant proposed a method of knitting a back collar that was continuous to a front collar on the periphery of a neck hole (Japanese Provisional Patent HEI 8-158209 and US. Pat. No. 5,584,197). According to this method, the respective wales of the collar are continuous, and the collar can be knitted integrally with the body. According to this method, a front body and a back body, that have been knitted up to the shoulders, are linked and bound off at the shoulders. Next, while a back collar, that is continuous to the wales of a right front collar or a left front collar is knitted along the circumference of the neck hole, a wale of the back collar, said wale being the closest to the body side, is linked to the wales of the back body.

According to this method, after the front collar is knitted, the back collar will be transferred to invert the right-left order of stitches of the collar. After that, whenever the back collar is knitted, a stitch of the back collar and a stitch of the back body will be linked. The method can knit beautiful collared garments on a flat knitting machine, and has produced significant effects.

This method, however, reverses the order of stitches of the collar by using a method shown in the courses 3 through 5 of FIG. 11 of the above-mentioned patent. As a result, racking distances will increase, and the yarns will be subjected to undesirable tensions. The method has a problem that it is difficult to knit a collar with a large width.

SUMMARY OF THE INVENTION

The present invention is intended to knit a broad collar integrally with a body without increasing racking distances of needle beds of a flat knitting machine.

In the present invention, a flat knitting machine is used, wherein at least a pair of opposing needle beds, a first needle bed and a second needle bed, are provided, said needle beds having a large number of needles, at least one of said needle beds can be racked sidewise, and transfer of a wale or wales can be made between said needle beds, and a right front half body and a left front half body are made to belong to the first needle bed, a neck hole is provided between the right front half body and the left front half body, and a back body is made to belong to the second needle bed, and the right front half body, the left front half body and the back body are knitted, and a collar having a plural number of wales is knitted on both the right front half body and the left front half body along said neck hole.

To accomplish the above-mentioned objective, the present invention is characterized by a: a step of transferring at least one wale of said collar, said wale being located at an end opposite to the neck hole, between the needle beds to lay the wale on at least one wale of the back body, b: a step of moving at least one wale that was transferred in the step a towards the inner side of the neck hole by one wale to lay said wale of the collar's end on another wale of the back body, c: a step of moving at least one wale that has been moved, towards the inner side of the neck hole by one wale to lay said wale of the collar's end on another wale of the back body, leave one empty needle in the position taken before the move, and transfer one wale of the collar that has not been transferred, onto said empty needle, d: a step of moving wales of the collar that were transferred in steps a through c, towards the inner side of the neck hole by one wale to lay said wale of the end of the collar on a wale of the back body, e: a step of repeating steps c and d till each wale of the collar is transferred, and f: a step of knitting the back portion of the collar on the back body.

In the present invention the issue is continuation of the front portion and the back portion of a collar in terms of the direction of wales. Hence the concept of wale is used. Wale is a row of stitches in a direction perpendicular to the knitting direction. Move or transfer of a wale means move or transfer of one stitch of the wale that is held on a needle, and this results in a move or transfer of the entire wale. Belongingness of a front body or a back body means that the front body or the back body belongs to a needle bed on which the the front body or the back body of the completed garment forms the face stitches of jersey. In garments stitches such as rib stitch and garter stitch are formed besides face stitches of jersey. Hence catching or holding of stitches alone can not determine belongingness of a knit fabric.

In the present specification transfer means a change in position of a wale between needle beds, and a move means a move of a wale within the same needle bed. A move is executed by, for example, two transfers; for example, in a sequence of a transfer onto the opposite needle bed, relative racking of the needle beds, and a retransfer.

In the embodiment, one wale is moved at a time in the above-mentioned steps a and c. However, this operation is not limited to it. For example, in the step a, two wales may be transferred to invert the order of them, and the wale of the collar on the end of the body side may be laid on a wale of the back body. In the step c, two wales may be transferred; a wale that is closer to the end of the body side or wale on body side may be transferred onto an empty needle, and the stitch on the neck hole side may be transferred to the side opposite to the neck hole seen from the empty needle. However, preferably, in the above-mentioned steps a and c, one wale of the collar is transferred per step. In this way, the racking distance can be minimized.

According to the present invention, transfer of the collar is completed by steps a through e. In these steps, one transfer is accompanied by two moves, and these two moves are accompanied by twice of formation of double stitches. Whenever double stitches are formed, the wale of the collar on the end of the body side is laid on a stitch of the back body, and the wale of the collar on the end of the body side is connected to the final course of the back body. Hence the wale direction of the collar and the wale direction of the back body are perpendicular to each other. Racking distance required for transfer or move is short. For example, when transfer is literally made by one wale, the racking distance is roughly for one wale.

Preferably, making each of said steps a, b, c and d, at least one course of stitches is knitted for each wale of the collar as a step g. This will remove the double stitches from the needle, and the stitch of the next course will become the target of next move or transfer.

Preferably, in said step g, yarn is fed to the wale that has been transferred and to the wale to be transferred subsequently from a direction opposite to the yarn feed direction for other wales of the collar. This is to eliminate twist of stitch generated by transfer.

As described above, according to the present invention, the racking distance required for transfer of the collar can be minimized. Hence a collar of a broad width can be knitted, and in turn, more diverse range of products can be knitted on a flat knitting machine.

EMBODIMENT

The embodiment will be described with reference to the attached drawings. The embodiment is performed on a flat knitting machine wherein at least one pair of a front needle bed and a back needle bed are provided, said needle beds extend sidewise and oppose to each other one in front and the other in the rear, each of said pair of needle beds has a large number of needles, the pair of the front and back needle beds are provided with teethed portions on their opposing faces, at least one of the front and back needle beds can be racked sidewise, and transfer of a stitch or stitches can be made between said needle beds. Said flat knitting machine may be a so-called flat knitting machine with two beds, one with three beds or one with four beds.

The present embodiment will be explained by taking an example wherein a vest is knitted as a collared garment on a flat knitting machine with two beds. Knitting is started, on a two-bed type flat knitting machine, with a rib hem part having rib stitch structure. The front body is made to belong to the front needle bed, and the back body is made to belong to the back needle bed, and the front body and the back body, one in front and the other in the rear, are knitted up into a virtually cylindrical form. This method is widely known (Japanese Patent HEI 3-75656 granted to the present applicant). According to this method, each needle having a stitch is provided with an empty needle for transfer on the opposing needle bed. Structure for the front body and the back body is not limited to plain stitch, and rib stitch may be used. When a course of stitches of the front body is knitted, the back body is held on needles of the back needle bed. When the back body is knitted, the front body is held on needles of the front needle bed.

Figure 1:
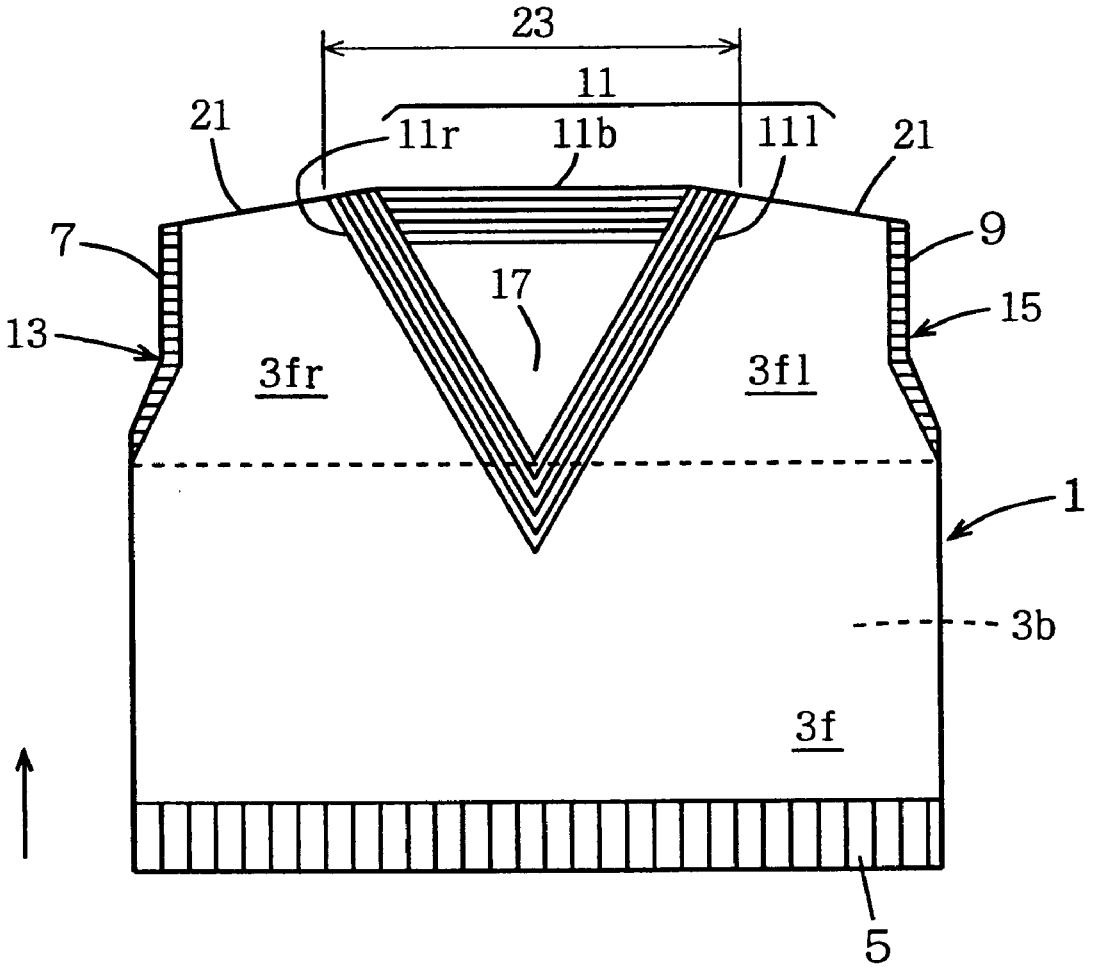
FIG. 1 is a front view of a vest to be knitted in the embodiment.
Figure 2:
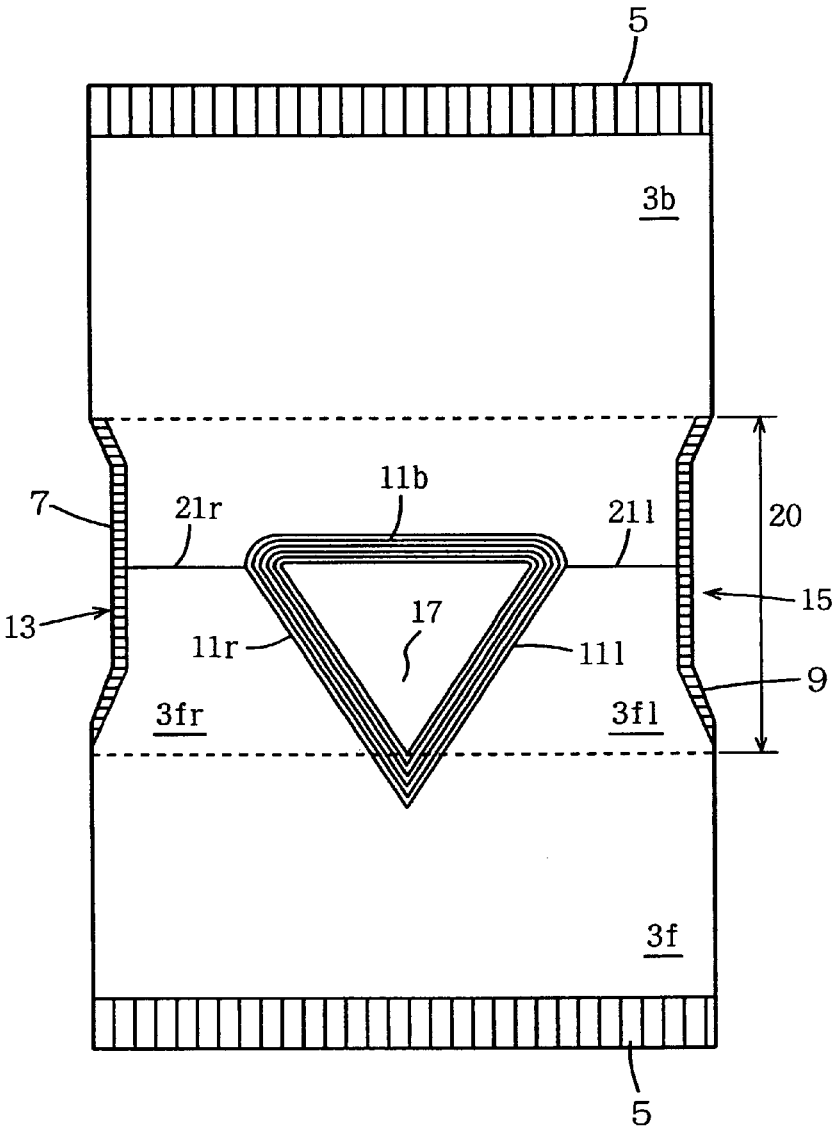
FIG. 2 is a diagram showing the vest of FIG. 1 in a condition cut along both sides and developed.

FIG. 1 is a front view of a vest I that is seamlessly knitted. FIG. 2 is a development of the vest 1 of FIG. 1, and the vest 1 is cut along both sides. A front body 3*f* and a back body 3*b* of the vest 1 are suspended by a front needle bed and a back needle bed, respectively. Knitting starts from a rib hem part 5 and proceeds in the direction of arrow. Holes 13, 15 and 17 are arranged near arm holes 7 and 9 and a collar 11, respectively. When the formation of the neck hole 17 is started in the front body 3*f*, the front body 3*f* will be divided and knitted into a right front half body 3*fr* and a left front half body 3*fl*, with the neck hole 17 being held between them. Collars 11*r* and 11*l*, each comprising an appropriate number of wales, are knitted on the neck-hole side ends of the right front half body 3*fr* and the left front half body 3*fl* along the neck hole 17 concurrently with the knitting of the front body 3*f* and the back body 3*b*. A back collar is knitted in a collar region 23 comprising needles that are holding stitches of the final course of the back body 3*b*. The back collar 11*b* is knitted in such a way that its wale direction is continuous to the right front collar 11*r* and the left front collar 11*l* of the front body 3*f*.

In an area 20 in which holes 13, 15 and 17 are formed, the right front half body 3*fr*, the left front half body 3*fl* and the back body 3*b* are knitted by different yarn feeders, respectively. The front body 3*f* and the back body 3*b* are knitted in parallel on the front needle bed and the back needle bed, respectively. When their knitting is completed up to the shoulder 21, the right front half body 3*fr* except the left front collar 11*l* and the back body 3*b* are linked integrally and bound off in the left shoulder 21*r*, then they are removed from the needles. Similar knitting is made for the left front half body 3*fl* except the left front collar 11*l* and the back body 3*b*.

Figure 3:
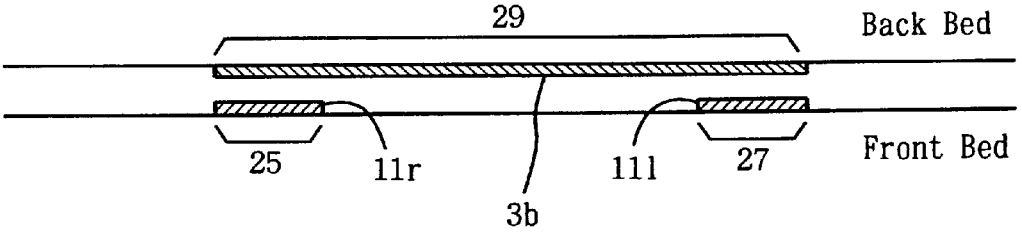
FIG. 3 is a diagram showing the holding conditions of the stitches when the binding off of the shoulders is completed.

The state of the vest on the needle beds at the time of completion of the above-mentioned knitting is shown in FIG. 3. The stitches of the right front collar formed on the neck hole side of the right front half body 3*fr* are held on odd-numbered needles of a region 25 of the front needle bed. The stitches of the left front collar 11*l* formed on the left front half body 3*fl* are held on on odd-numbered needles of a region 27 of the front needle bed. Between the two regions there is a region of empty needles corresponding to the position of the neck hole 17. On the back needle bed, stitches of the final course of the back body 3*f* are held on even-numbered needles of a needle region 29. When the back collar 11*b* is knitted, the stitches of the region 29 will be linked sequentially with the stitches of the back collar 11*b*. Stitches of other portions of the shoulder 21 have been removed from the needles. Thus the right and left front collars 11*r* and 11*l* and the back collar 11*b* which is formed in succession to the front collars are arranged to oppose the collar region 23.

Figure 4:
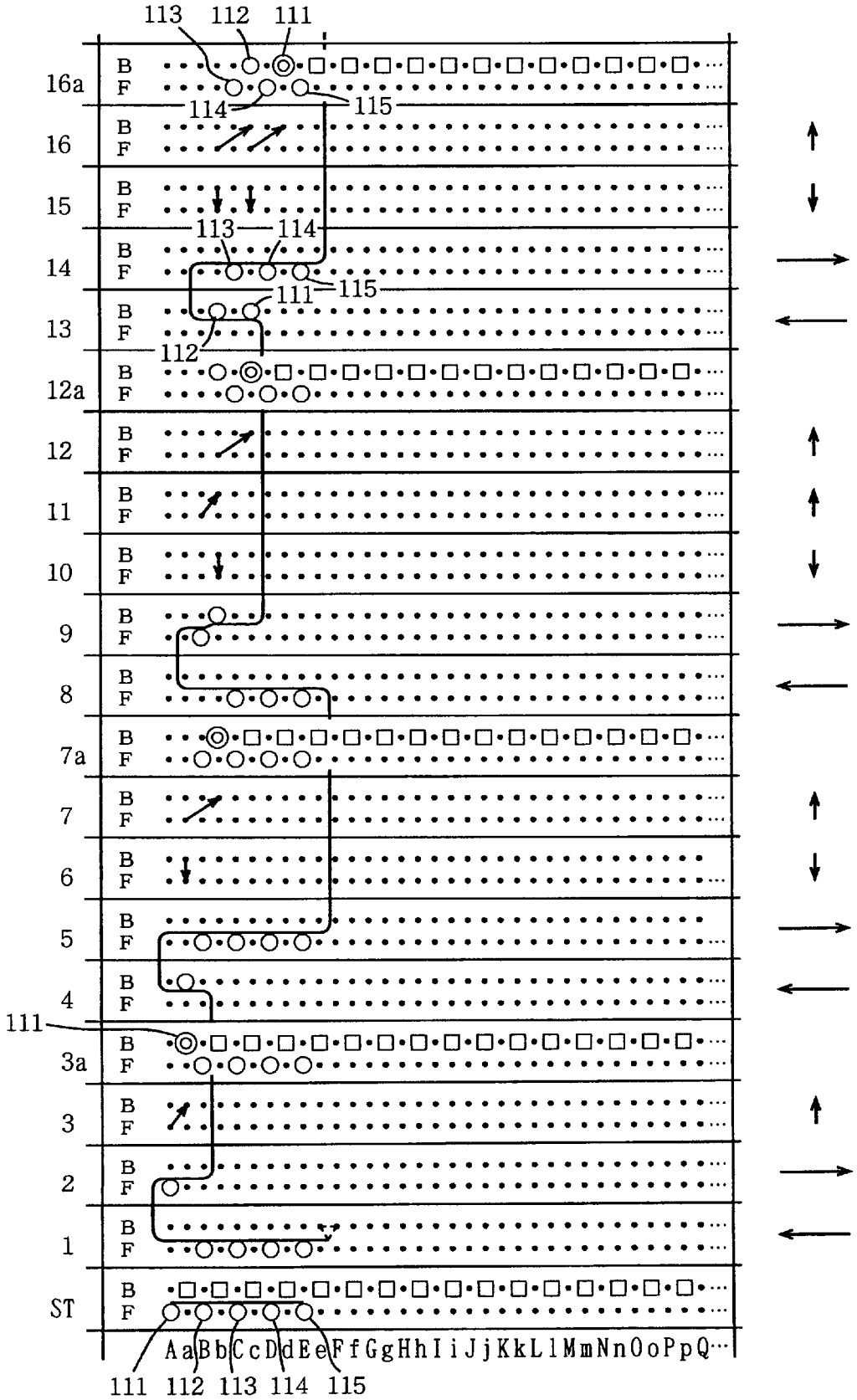
FIG. 4 is a diagram showing the outline of the knitting method of the embodiment.
Figure 5:
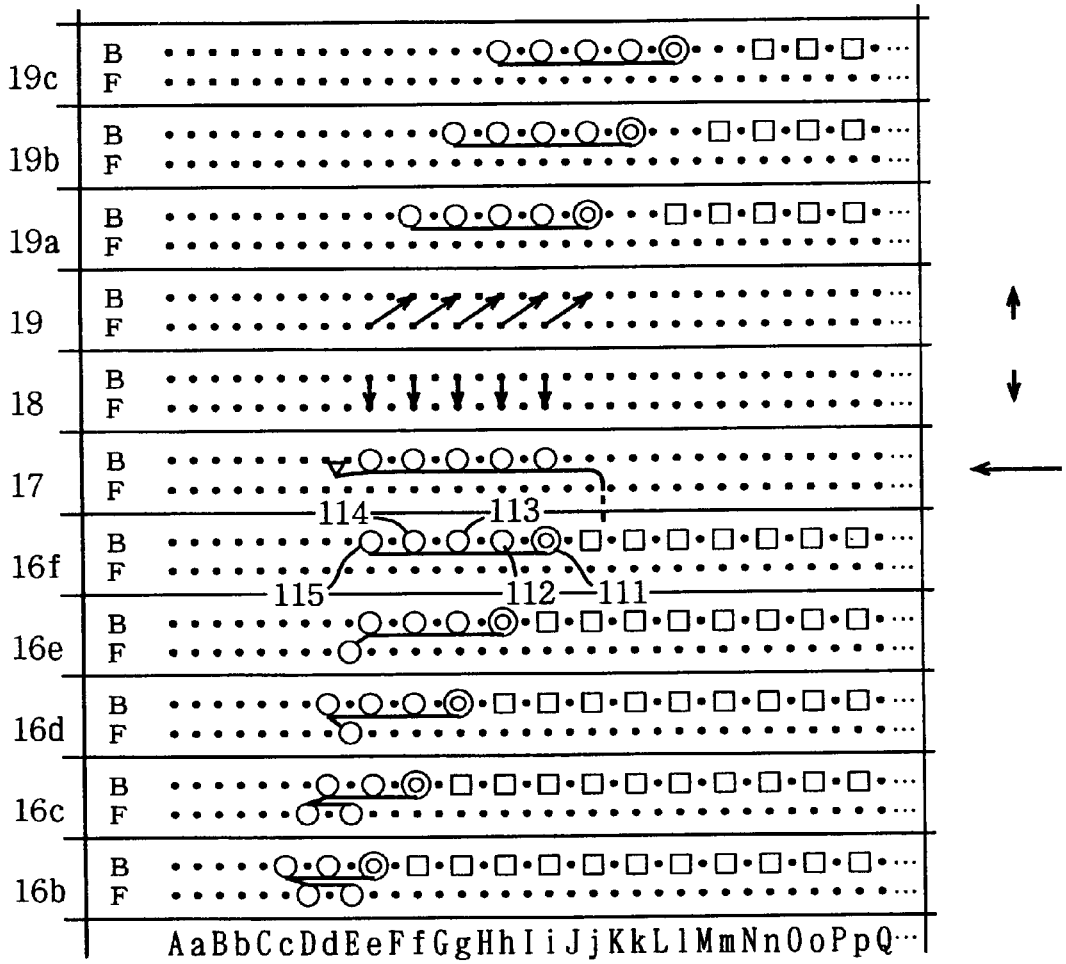
FIG. 5 is a diagram showing knittings blocks subsequent to FIG. 4.

In succession to the knitting of the right and left front collars 11*r* and 11*l*, the back collar 11*b* is knitted. The back collar 11*b* may be knitted, as shown in FIG. 16 of Japanese Provisional Patent HEI 8-158209, directly next to the right front collar 38*a* while the left front collar 48*b* is held in position. Or as shown in FIG. 18 thereof, the back collar portions may be knitted next to both the right and left front collars, and the portions may be linked together, for example, at the center of the collar region. Moreover, as shown in FIG. 20 through FIG. 23 of the same patent, after knitting of the right front collar, the back collar may be knitted without inverting the order of stitches, and after that, the order of the stitches may be inverted. In the present embodiment, however, explanation is given to a case when knitting of the left front collar 11*l* is interrupted and the back collar 11*b* is knitted next to the right front collar 11*r*. FIG. 4 and FIG. 5 show knitting blocks for linking the right front collar 11*r*, that can be seen on the left when the vest in the condition of FIG. 3 is seen from the front, and the stitches of the back body opposing the right front collar 11*r*. In particular, FIG. 4 and FIG. 5 show formation of stitch courses, transfer and move of stitches, and states of needle beds after move of stitches. In the knitting blocks, numbers on the left end show block numbers, and F indicates the front needle bed and B indicates the back needle bed. Capital letters of alphabet marked in the bottom of the diagram indicate odd-numbered needles, and small letters of alphabet indicate even-numbered needles. The arrows in the right-left direction indicate the moving direction of a yarn feeder 12. The arrows in vertical direction indicate the direction of stitch transfer between needle beds.

As shown in ST of the diagram, the stitches of the right front collar 11*r* are held on odd-numbered needles A, B, C, D and E. Between the right front collar 11*r* and the left front collar 11*l* (not illustrated) are there needles e, F, f, G . . . of the front needle bed, corresponding to the position of the neck hole 17 of the front body 3*f*. On the back needle bed, stitches of the collar region 23 for forming the back collar 11*b* on the back body 3*b* are held on even-numbered needles a, b, c, d, e, . . . . For the convenience of explanation, the collar is assumed to comprise five wales 111~115 of plain stitch. However, it should be noted that the number of wales may be increased more to knit a wider collar and that the stitch structure of the collar may be changed to rib stitch or garter stitch. Every time one course of the back collar 11*b* is knitted, the stitch of the back collar 11*b* closest to the body side is linked with a stitch of the final course of the back body 3*b*.

First, to knit the back collar directly next to the right front collar 11*r*, knitting operations of the blocks 1 through 3 are made. As a result, the first stitch course of the back collar 11*b* is formed. To be more specific, when knitting of the right front collar 11*r* is completed, the yarn feeder 12 is standing on the right side of the right front collar 11*r*. In the block 1, the yarn feeder 12 is moved to the left to feed yarn to needles E, D, C, B holding stitches of the right front collar 11*r* except the needle A to form stitches. In the next block 2, yarn is fed to the needle A of the front needle bed holding the stitch of the side end wale 111 of the right front collar 11*r*, in a direction reverse to the yarn feeding direction for other needles to form a stitch. In this way the first stitch course of the back collar 11*b* is knitted. The stitch of the wale 111 on the side end, which was formed by feeding yarn in the reverse direction in the above-mentioned block 2, is formed in such a condition that yarns are crossed at the base of the stitch and the stitch is twisted. The twist of this stitch is eliminated when the stitch is transferred onto a needle a of the back needle bed in the subsequent block 3 of transfer.

The block 3*a* shows the conditions of the needle beds when knitting of the blocks 1 through 3 is completed. The stitch of the wale 111 at the left end of the right front collar 11*r* is laid on the stitch on the left end of the back body 3*b* on the needle a of the back needle bed. In blocks 4 and 5, the next stitch course is knitted on the back collar 11. In the block 4, the yarn feeder 12 is moved to the left to feed yarn to the needle a of the back needle bed and form a stitch of the side end wale 111 of the back collar 11*b*. In the block 5, the yarn feeder 12 is reversed and moved to feed yarn to the needles B, C, D and E of the front needle bed to form stitches of wales 112 through 115, following the wale 111, of the back collar 11*b*, In blocks 6 and 7, the stitch of the side end wale 111 of the back collar 11*b* being held on a needle of the back needle bed is laid, via the next needle b, on the stitch of the back body 3*b*. The block 7*a* shows the condition when the above-mentioned knitting is completed. The stitch of the back body 3*b* which was held on the needle a has been linked with the stitch of the side end wale 111 of the back collar 11*b* and has been removed from the needle.

Blocks 8 and 9 show knitting of the next stitch course of the collar. In the block 8, the yarn feeder 12 is moved to the left to feed yarn to the needles E, D and C of the front needle bed and form stitches of the wales 113 through 115. In the block 9, yarn is fed in the reverse direction to the stitch of the wale 112 that is to be transferred to the back needle bed, with an objective similar to that of the block 2 above, to form a stitch of the wale 112. At the same time, yarn is fed to the needle b of the back needle bed to form a stitch of the wale 111.

In blocks 10 through 12, the stitch of the back collar 11*b* is moved and linked with the back body 3*b*. The stitch of the back collar 11*b* held on the needle b of the back needle bed is moved onto the next needle c of the same needle bed, the needle c holding a stitch of the back body, and a stitch held on the needle B of the front needle bed is transferred onto the needle b of the back needle bed. The block 12*a* shows the conditions of the needle beds when knitting of the above-mentioned blocks 8 through 12 is completed. The stitches of the wales 111 and 112 of the back collar 11*b* have been transferred onto the needles b and c of the back needle bed, and the stitches of the wales 113 through 115 are held as before on the needles C, D and E of the front needle bed.

In the next blocks 13 through 16, one course of the back collar 11*b* is knitted, then the stitch of the wale 111 held on the needle c of the back needle bed is linked with the stitch of the back body held on the needle d of the same needle bed. The block 16*a* shows the conditions of the needle beds when the above-mentioned knitting is completed. In subsequent processes, every time a stitch course of the back collar 11*b* is formed, stitches are moved as before, and the stitch of the side end wale 111 is laid on the stitch on the side end of the back body 3*b*. In parallel with this, the stitches of the wales 113 through 115 held on needles of the front needle bed are sequentially transferred onto needles of the back needle bed. Blocks 16*b* through 16*f* (knitting courses are not illustrated) show the conditions of the needle beds at the respective stages of linking of the back collar 11*b* and the back body 3*b*. As the linking advances, stitches (wales 113 through 115) of the collar are transferred sequentially onto the needles of the back needle bed. In the block 16*f*, stitches of all wales 111 through 115 of the back collar 11*b* have been transferred onto the needles of the back needle bed, and the stitch of the wale 111 have been linked with the stitch of the back body 3*b* held on the needle i. In this way, the stitches of the respective wales of the collar are sequentially moved, in combination with the knitting of the stitch courses. In this way, the right-left order of stitches of the collar is inverted.

After the completion of inversion of the stitch order of the back collar 11*b*, knitting of the back collar 11*b* and subsequent locking/knitting with the back body 3*b* can be done by using the method described in the preceding application. A part of the knitting is shown in the block 18 and following blocks.

As explained above, the right-left inversion of the stitch order of the back collar 11*b* is made by using needles of the region that held stitches of the back body 3*b* but are released one after another by locking/knitting. Thus a stitch is moved by using a nearby needle on the opposing needle bed. As a result, the racking distance of the needle bed is not long. The back collar 11*b* to be linked to the back body 3*b* is knitted in succession of the right front collar 11*r* by the above-mentioned method, and stitch wales of the right front collar 11*r* and the following back collar 11*b* that are formed on the circumference of the neck hole 17 are continuous. The above-mentioned knitting method can be applied to inversion of stitch order for knitting a more wider collar in the same manner without any changes. As a result, design of knits can be diversified more without increasing the racking distance nor modifying the structure of the flat knitting machine.

Figure 6:
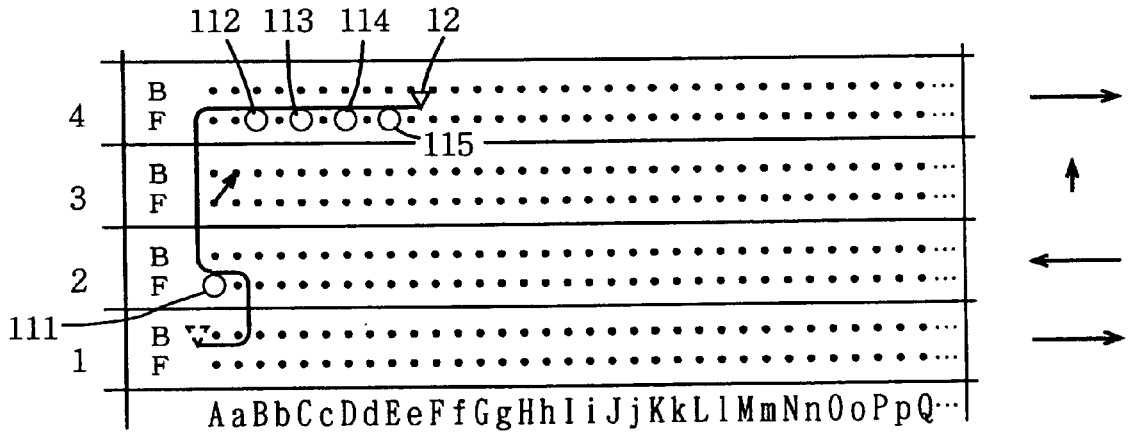
FIG. 6 is a diagram showing a modification of blocks 1 through 3 of FIG. 4.
Figure 7:
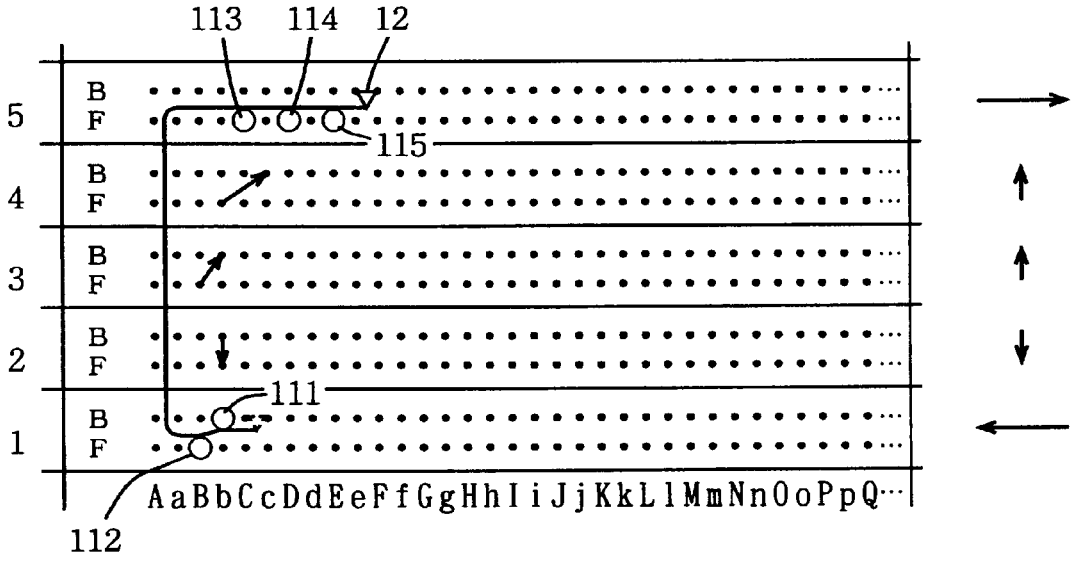
FIG. 7 is a diagram showing a modification of blocks 8 through 12 of FIG. 4.

FIG. 6 shows another knitting method that prevents twisting of stitch that occurs when a stitch of the back collar 11*b* held on the front needle bed is transferred onto a needle of the back needle bed. This method is used when the stitch course of the back collar 11*b* is knitted from the wale 111 on the left end to the wale 115 on the right end, and corresponds to the blocks 1 through 3 of FIG. 4. In the block 2, yarn is fed in the reverse direction to form the stitch of the wale 111, then in the following block 3, said stitch formed is transferred onto the back needle bed, and in the next block 4 the stitches of the remaining wales 112 through 115 are formed. Similarly, in FIG. 7 shows knitting blocks corresponding to the blocks 8 through 12 of FIG. 4. In the block 1 yarn is fed to the wale 111 in the reverse direction to form a stitch, then the stitch is transferred first (blocks 2 through 4), and the stitches of the remaining wales 113 through 115 are formed.

Application of the knitting method of the present invention is not limited to vests, and can be applied to collar knitting of knit garments such as sweater and cardigan. In the case of cardigan, yarn is reciprocatively fed in the order of rib hem part—right front half body—back body—left front half body to knit the garment. The collar is formed next to the front panels that are formed by a plural number of wales on the edges of the knitted fabric of the front body. As a result, a collar integrally knitted with the front panels is formed. When a flat knitting machine with four beds is used in place of a flat knitting machine with two beds, there is no need of dividing the fabrics into two groups; one held on odd-numbered needles and the other held on even-numbered needles. The collar 11 may be knitted by using a yarn that differs from the yarn used for front body 3*f*. Furthermore, the structure of the collar may be rib stitch or garter stitch in place of plain stitch. The present invention is not limited by any sense to the embodiment, and can be modified within a range that does not deviate from the gist of the invention.

I claim:

1. A method of knitting a collar comprising:

using a flat knitting machine, wherein at least a pair of opposing needle beds including a first needle bed and a second needle bed, are provided, said needle beds having a large number of needles, at least one of said needle beds can be racked sidewise, and transfer of a wale or wales can be made between said needle beds, and making a right front half body and a left front half body belong to the first needle bed, providing a neck hole between the right front half body and the left front half body, and making a back body belong to the second needle bed, and knitting the right front half body, the left front half body and the back body, and knitting a collar having a plural number of wales on both the right front half body and the left front half body along said neck hole, including (a): transferring at least a first wale of said collar located at an end of the collar opposite to the neck hole, between the needle beds to lay at least said first wale of the collar on a first needle of the second needle bed holding a first wale of the back body, (b): moving at least said first wale of the collar that was transferred in the step (a) towards an inner side of the neck hole by one wale pitch to lay said first wale of the collar on a second needle of the second needle bed holding a second wale of the back body, (c): moving at least said first wale of the collar that has been moved in step (b), towards the inner side of the neck hole by one wale pitch to lay said first wale of the collar on a third needle of the second needle bed holding a third wale of the back body, leave the second needle of the second needle bed empty and transfer a second wale of the collar that has not been transferred on the second needle of the second needle bed, (d): moving said first wale of the collar and the second wale of the collar transferred in steps (a) through (c) towards the inner side of the neck hole by one wale pitch to lay said first wale of the collar on a fourth needle of the second needle bed holding a fourth wale of the back body, (e): repeating steps (c) and (d) until each wale of the collar is transferred, and (f): knitting the back portion of the collar on the back body.

2. A method of knitting a collar of claim 1 wherein in said steps (a) and (c), only one wale is transferred.

3. A method of knitting a collar of claim 2 further comprising:

(g) knitting at least one stitch course for each wale of the collar before executing each of steps (a), (b), (c) and (d).

4. A method of knitting a collar of claim 3 wherein, before executing each of steps (b), (c) and (d), in said step (g); yarn is fed to a wale that has been transferred and to a wale to be transferred next in a direction reverse to a yarn feeding direction for other wales of the collar.

* * * * *